US006904624B2

(12) United States Patent
Leung et al.

(10) Patent No.: US 6,904,624 B2
(45) Date of Patent: Jun. 14, 2005

(54) SAUNA

(75) Inventors: Anthony Kit Lun Leung, Hong Kong (CN); Brenda P. K. Yue, Hong Kong (CN); Kam Fai Fung, Hong Kong (CN)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/463,208

(22) Filed: Jun. 17, 2003

(65) Prior Publication Data

US 2004/0025242 A1 Feb. 12, 2004

Related U.S. Application Data

(60) Provisional application No. 60/389,547, filed on Jun. 18, 2002.

(51) Int. Cl.[7] ..... A61H 33/06

(52) U.S. Cl. ..... 4/537; 4/535; 4/524; 4/525; 607/83

(58) Field of Search ..... 128/200.14, 200.16, 128/200.17, 200.21, 368, 256; 4/537, 536, 535, 524, 525, 598; 607/82, 83; 604/291

(56) References Cited

U.S. PATENT DOCUMENTS 4,300,556 A * 11/1981 Ochi et al. ..... 607/82
6,712,290 B2 * 3/2004 Chien ..... 239/135
2002/0056466 A1 * 5/2002 Omura ..... 607/83

* cited by examiner

*Primary Examiner*—Khoa D. Huynh
(74) *Attorney, Agent, or Firm*—Ohlandt, Greeley, Ruggiero & Perle LLP

(57) ABSTRACT

A sauna is provided that has a steam device and a mist device for providing steam and mist to a user. The steam device can heat a portion of the liquid to increase efficiency. The mist device can vibrate the liquid to provide the mist.

27 Claims, 7 Drawing Sheets

SAUNA

RELATED APPLICATION

This application is related to and claims priority in, co-pending U.S. Provisional Application Ser. No. 60/389,547, filed Jun. 18, 2002, the disclosure of which is incorporated herein by reference.

BACKGROUND OF THE INVENTION

1. Field of the Invention

The present invention relates to saunas. In particular, the present invention relates to saunas that can apply a vapor to a user and/or a user's face.

2. Description of the Prior Art

A sauna is a personal care device that allows a user to receive a vapor. The sauna can apply the vapor to various parts of the body, and, in particular, apply the vapor to the face of the user. These devices suffer from the drawback of requiring extended heat up times where hot steam is to be applied to the user's face.

The present invention relates to an improved sauna that can provide vapors of different temperatures to a user and, in particular, to the user's face.

SUMMARY OF THE INVENTION

It is an object of the present invention to provide a sauna.

It is another object of the present invention to provide a facial sauna.

It is a further object of the present invention to provide such a sauna that provides vapors of different temperatures to the user at the same time.

It is still another object of the present invention to provide such a sauna that generates a vapor from vibration of the substance.

It is yet another object of the present invention to provide such a sauna that generates vapor in reduced time.

These and other objects and advantages of the present invention are achieved by a sauna device for vaporizing a substance, which has a body having an exhaust area and a vapor apparatus. The vapor apparatus generates a first vapor having a first temperature from the substance, and also generates a second vapor having a second temperature from the substance. The vapor apparatus can provide the first and second vapors to the exhaust area at substantially the same time.

In another aspect, a sauna device for use with a substance is provided, which comprises a first vapor apparatus and an exhaust area. The first vapor apparatus has a heater, a first chamber with a first volume, and a second chamber with a second volume. The exhaust area is in fluid communication with the first vapor apparatus. The first volume is substantially smaller than the second volume. The heater is in thermal communication with the first volume for heating the substance thereby generating a first vapor from the substance. The heater is in substantial thermal isolation from the second volume. The first and second volumes are in fluid communication.

In another aspect, a method of providing vapor to a user is provided, which comprises generating a first vapor having a first temperature from a substance; generating a second vapor having a second temperature from the substance; and providing the first and second vapors to the user at substantially the same time.

The vapor apparatus may also have the ability to individually provide the first vapor and the second vapor to the exhaust area. The first temperature can be above a boiling point of the substance and the second temperature can be below the boiling point of the substance. The second temperature can also be at or below room temperature.

The vapor apparatus can be a first apparatus and a second apparatus. The first apparatus can have a heater that heats the substance to generate the first vapor and the second apparatus can have a transducer that vibrates the substance to generate the second vapor. The first apparatus can have a first chamber with a first volume and a second chamber with a second volume. The first volume can be substantially smaller than the second volume. The heater is in thermal communication with the first volume, and is in substantial thermal isolation from the second volume. The first and second volumes and the exhaust area are in fluid communication.

The device can also have a hood that substantially surrounds the exhaust area thereby forming an exhaust volume. The exhaust volume can be sized for a user's face. The exhaust area can have a first opening for exhausting the first vapor and a second opening for exhausting the second vapor. The first opening can have an adjustable valve movable into a plurality of positions to adjust a direction of flow of the first vapor.

The first vapor apparatus can have a thermally conductive plate partially defining the first volume. The first volume has a thin rectangular shape. The heater is in thermal communication with the thermally conductive plate. The first vapor apparatus can have a heat sink in thermal communication with the heater and the thermally conductive plate. The device can also have a water chamber for storing the substance. The first vapor apparatus and the second vapor apparatus are in fluid communication with the water chamber.

DETAILED DESCRIPTION OF THE INVENTION

Figure 1:
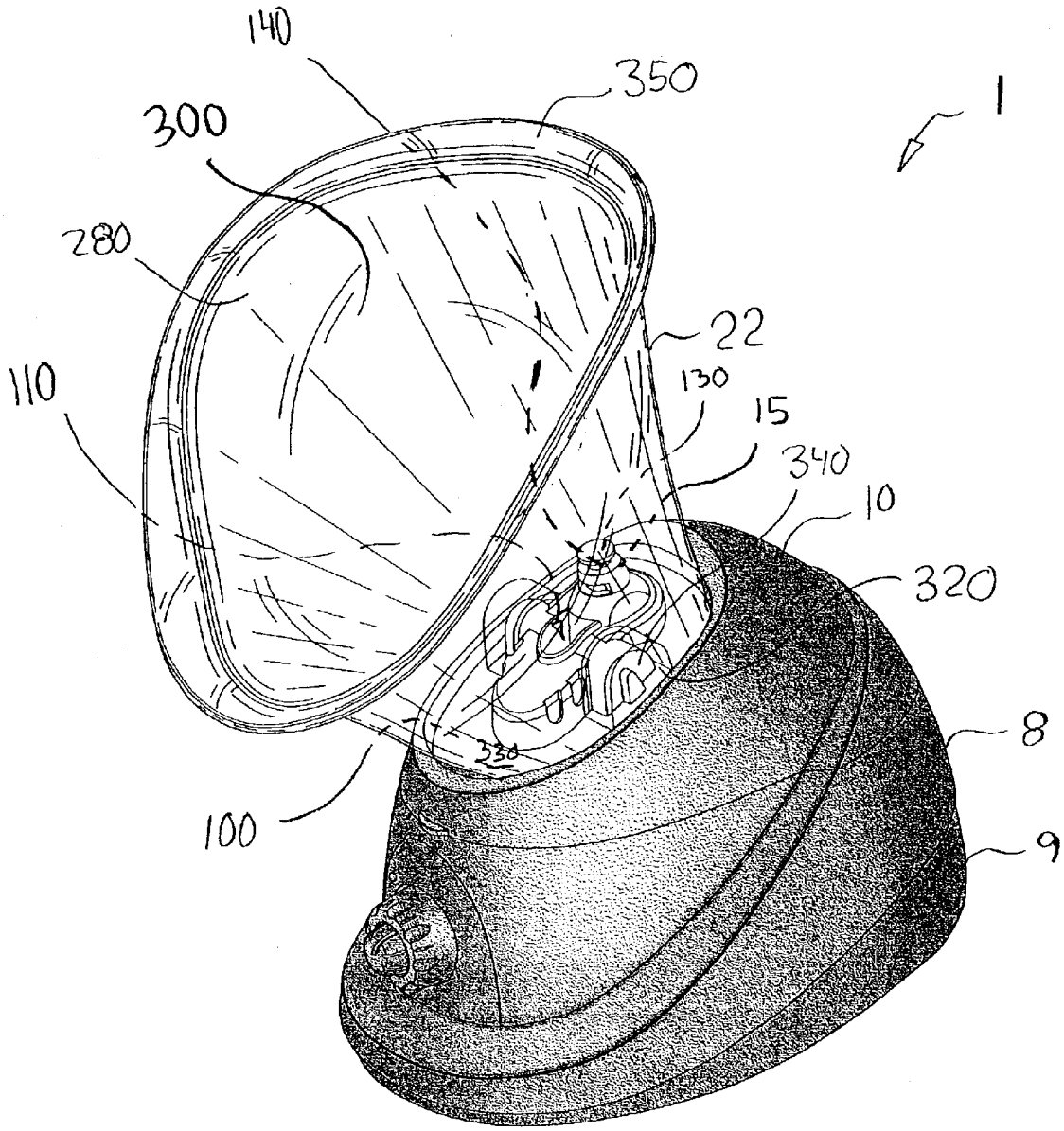
FIG. 1 is a perspective view of a sauna of the present invention.
Figure 2:
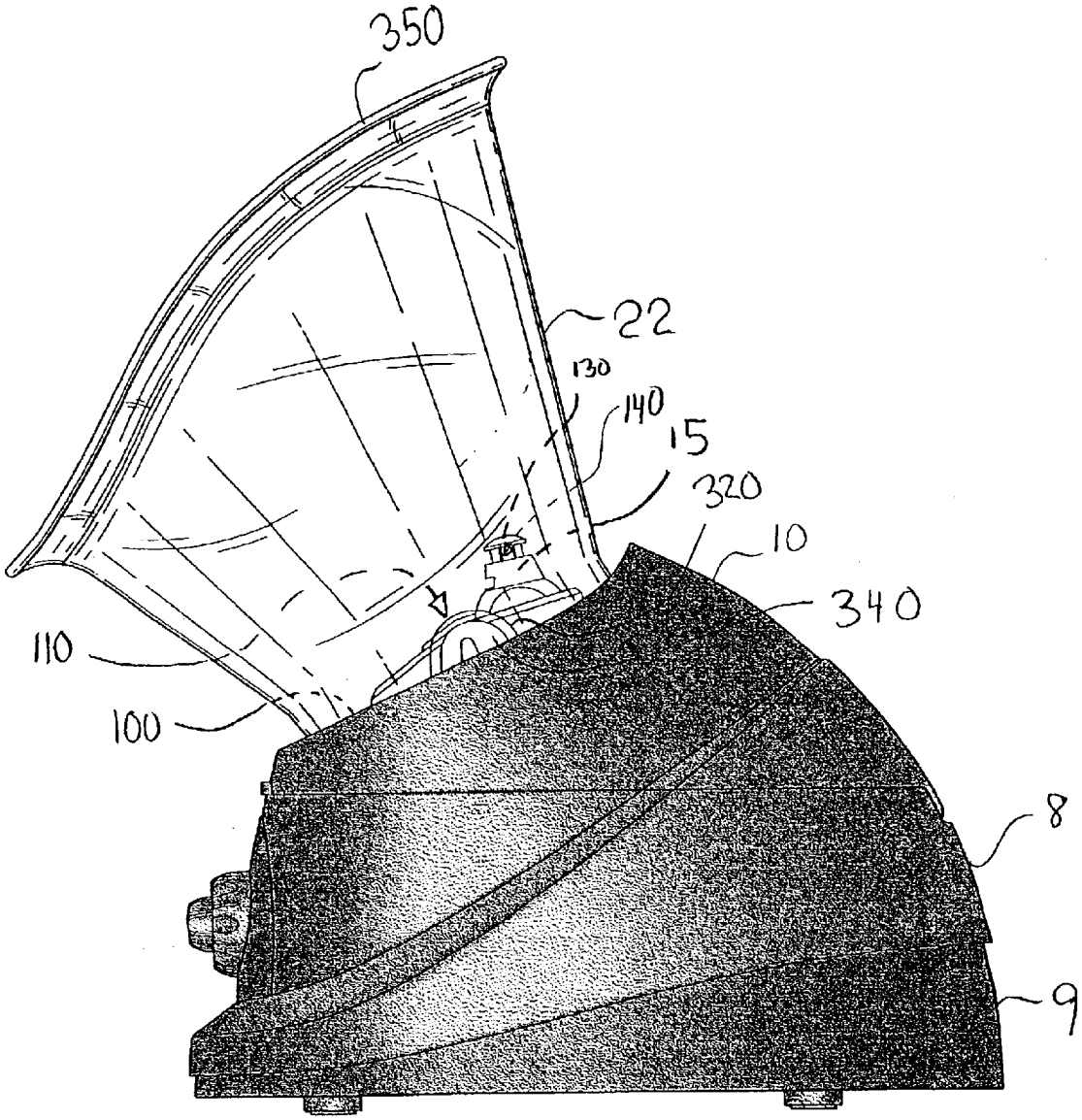
FIG. 2 is a side view of the sauna of FIG. 1.
Figure 3:
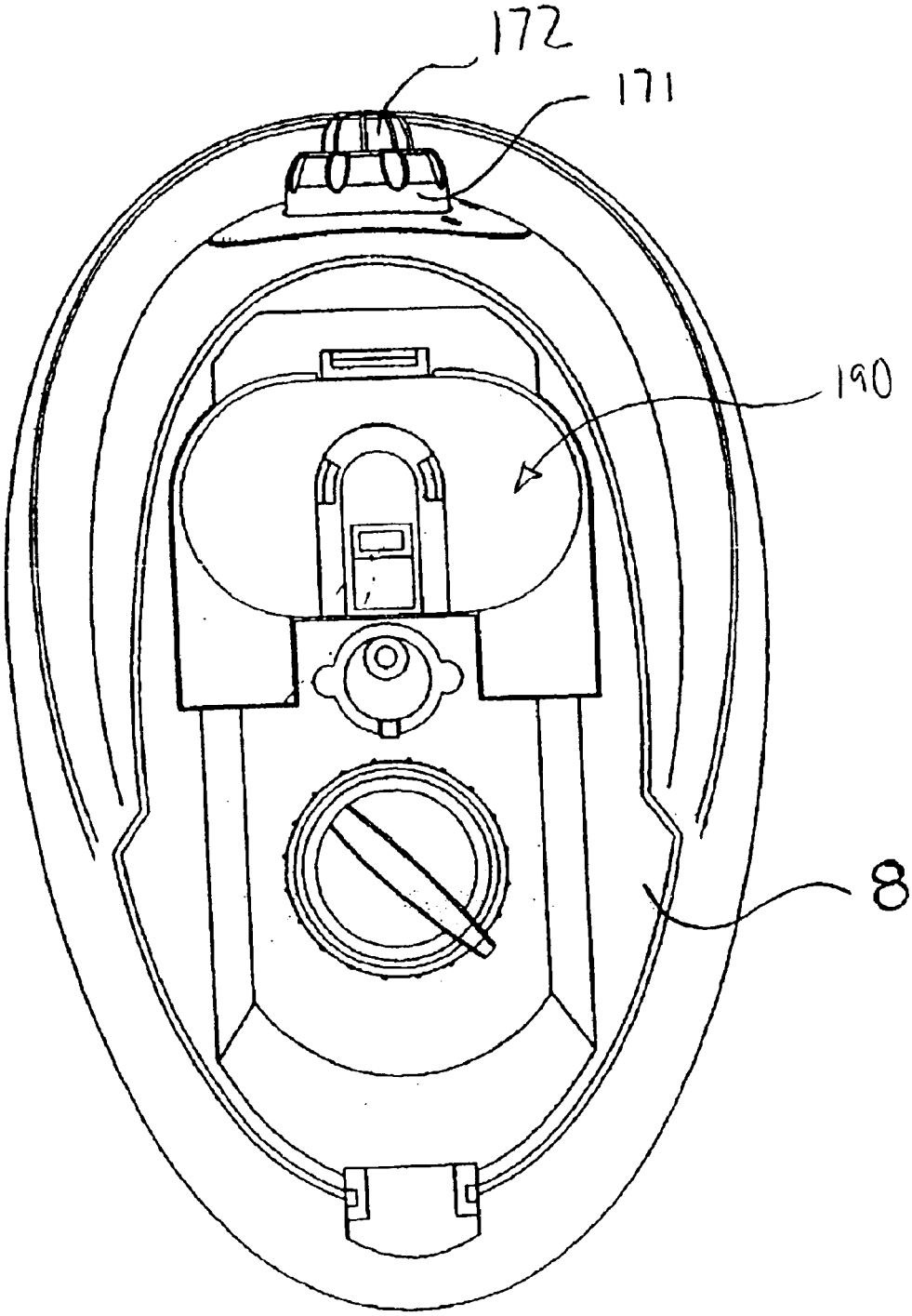
FIG. 3 is a top view of the sauna of FIG. 1 with the top and hood removed.

Referring to the drawings and in particular FIGS. 1 and 2, there is provided a sauna generally represented by reference numeral 1. The sauna 1 has a housing 8, a base 9, a top 10 and a hood 22. Top 10 is pivotally fastened at its rear to housing 8. Any known securing method can be used, such as, for example, bolts or a snap fit.

Sauna 1 can generate at least a first vapor at a first temperature and a second vapor at a second temperature from a substance. In the preferred embodiment, sauna 1 uses water as the substance being vaporized. The present disclosure contemplates the use of other liquids, combinations of liquids, combinations of liquids and meltable solids to be vaporized, and any other substances capable of being vaporized such as, for example, water combined with a medicine. As described herein, the vaporization of the liquid includes both vaporizing by raising the temperature of the liquid at or above its boiling point and atomizing or mechanically subdividing the liquid, such as by misting or nebulizing. The preferred embodiment generates steam by raising the temperature of a portion of the water above its boiling point and generates mist by vibrating water and mixing it with flowing air. The mist is at or below room temperature so that the user feels the sensation of application of both hot steam and cold mist simultaneously. However, the present invention contemplates the generation of first and second vapors at first and second temperatures of varying degrees.

Figure 4:
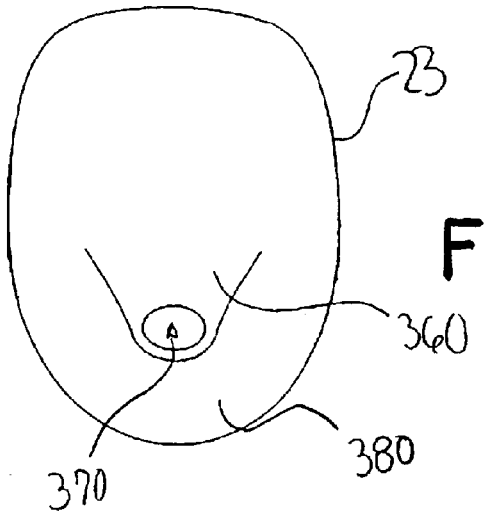
FIG. 4 is a top view of a duct usable with the sauna of FIG. 1.
Figure 5:
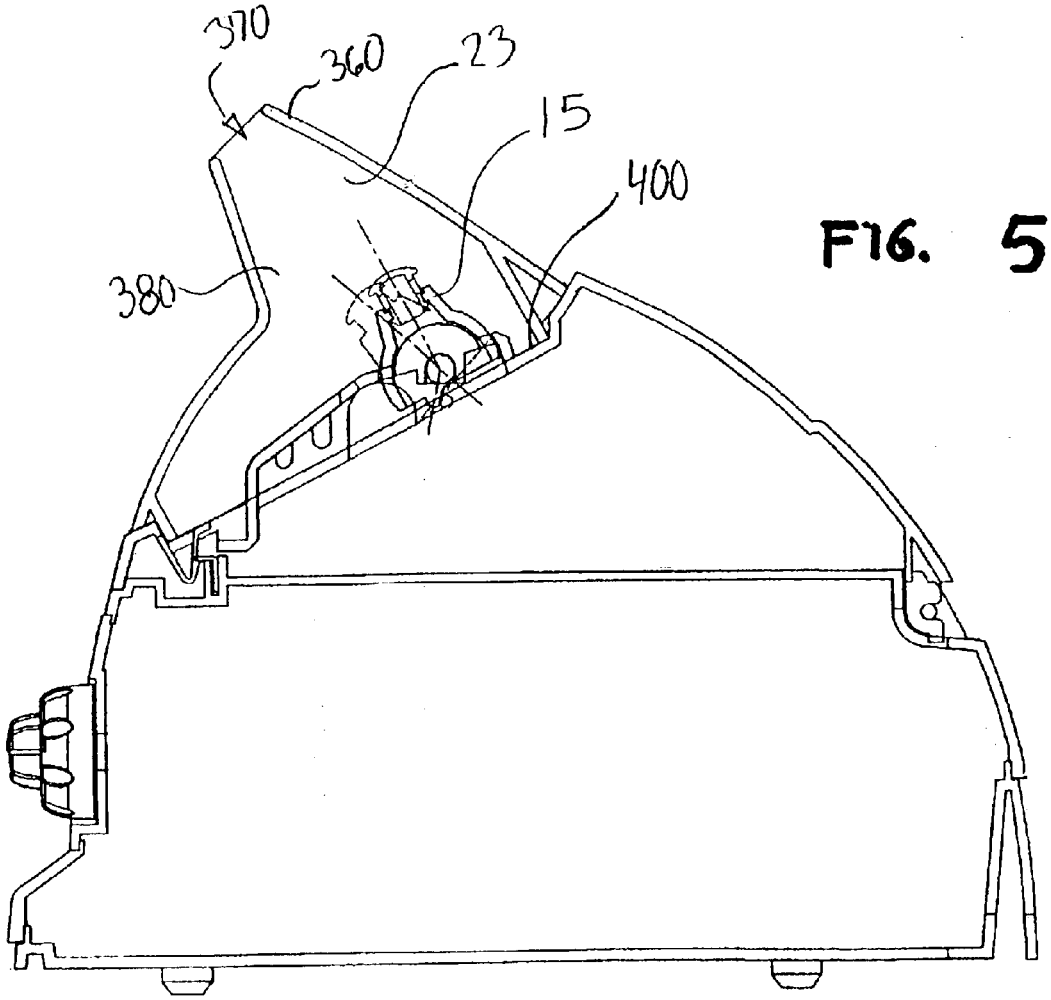
FIG. 5 is a partial cross-sectional view of the sauna of FIG. 1 with the duct of FIG. 5.

Referring to FIGS. 1 through 7, top 10 has a face 100 with a steam nozzle 15 secured thereto and a mist hole 110 therein. Preferably, steam nozzle 15 is pivotally secured to face 100 of top 10 such that the steam nozzle can pivot in a direction along the centerline of the face as shown in FIG. 5, with the steam nozzle represented in broken lines. Alternatively, steam nozzle 15 can be movably secured to face 100 so that the steam nozzle can pivot and rotate in any direction. Steam nozzle 15 has an intake 120 and an exhaust 130. The exhaust 130 of steam nozzle 15 has a number of slits 140 through which the first vapor or steam is exhausted.

Alternative exhausts 130 can also be used for emitting the steam. Exhaust 130 preferably is a swivel head rotatably mounted in the steam nozzle 15, which provides for a 360 degree rotation of the exhaust and thus rotation of the exhaust slits 140. The exhaust 130 can be cylindrical in shape with a top cap and two exhaust slits 140 positioned on opposing sides such that the direction of flow of the steam can be adjusted.

Figure 6:
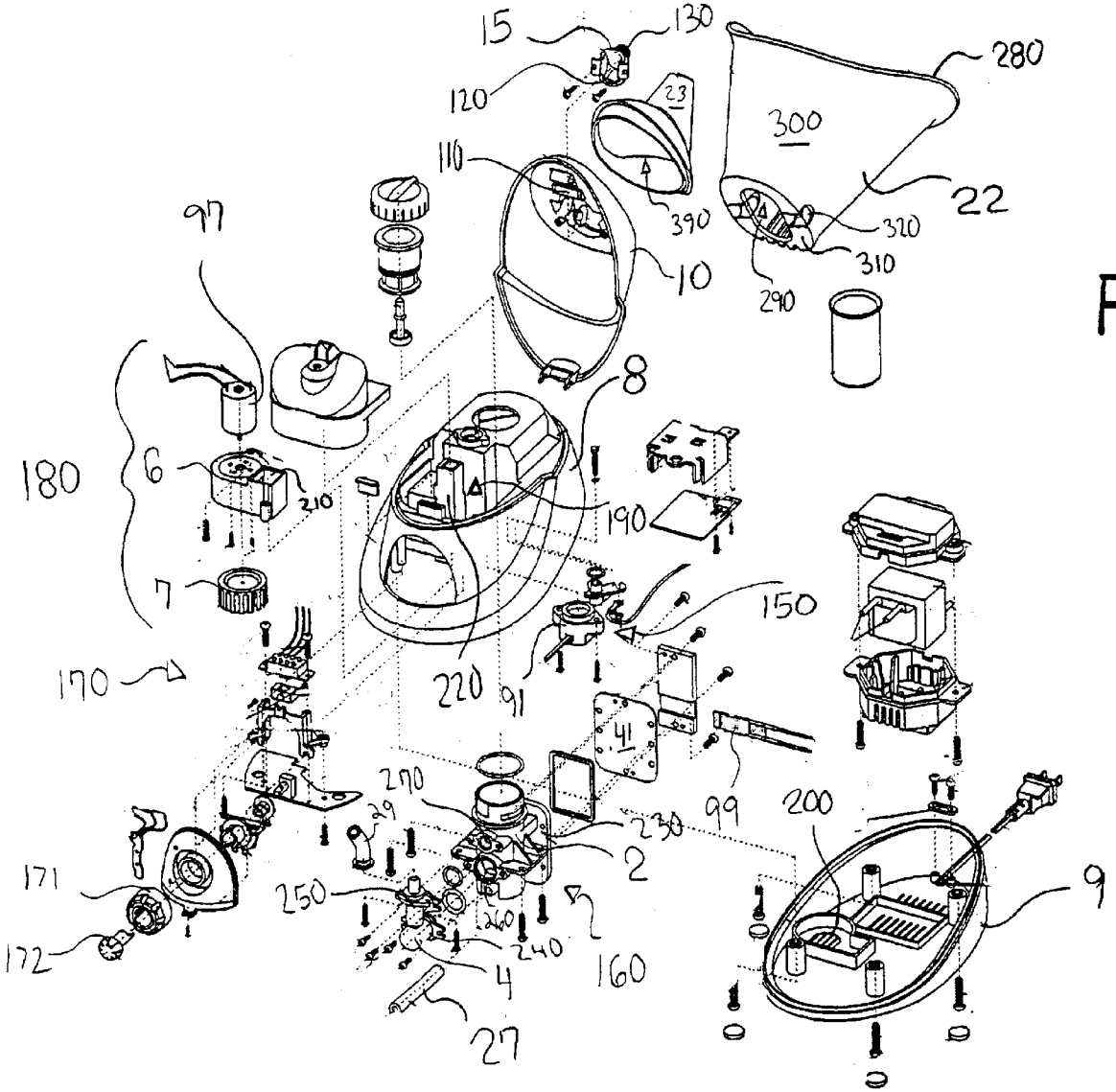
FIG. 6 is an exploded perspective view of the sauna of FIG. 1.

Referring to FIG. 6, housing 8 has a mist device 150, a steam device 160 and an electronic circuit 170. Mist device 150 has an air pump 180, a water chamber 190 and an atomizer, nebulizer or transducer 91. Air pump 180 has a fan 7 disposed in an air pump housing 6 that is partially defined by base 9. Fan 7 is rotated by a motor 97. Air pump housing 6 is in fluid communication with ambient air through intake holes or slots 200 in base 9. Air pump 180 also has an exhaust 210 that is in fluid communication with water chamber 190 through an air pump channel 220. Air pump channel 220 extends vertically from air pump housing 6 and has a rectangular shape. Air pump 180 causes ambient air to flow from underneath base 9 through intake holes 200, into air pump housing 6, through air pump exhaust 210, through air pump channel 220, into water chamber 190 and out through mist hole 110 in face 100 of top 10.

Transducer 91 is positioned at the base of water chamber 190 and is in fluid communication with the liquid, such as, for example, water, contained therein. The rapid vibration of transducer 91 mechanically subdivides the water causing mist to rise and mix with the air-flow from air pump 180 as it enters water chamber 190 through air pump channel 220. The mixture of mist and air passes through mist hole 110 in face 100 of top 10 and into hood 22.

Steam device 160 has a hot water chamber 2, a heating chamber 230 and a heater 99. Hot water chamber 2 is substantially cylindrical in shape. The base of hot water chamber 2 is in fluid communication with the base of water chamber 190 through a fill tube 27. Hot water chamber 2 and heating chamber 230 are adjacent to one another and are in fluid communication through first and second openings 231, 232. The first opening 231 is located near the bottom of hot water chamber 2 and the bottom of heating chamber 230. The second opening 232 is located near the middle of hot water chamber 2 and the top of heating chamber 230. In this embodiment, the second opening 232 is a pair of slots separated by a portion of the curved side-wall of hot water chamber 2.

Heating chamber 230 is a thin rectangular shaped volume having a flat, metal plate 41 on one of its sides, opposite to hot water chamber 2. In this embodiment, one side of heating chamber 230 is integrally formed with hot water chamber 2. However, heating chamber 230 and hot water chamber 2 can be separately formed and in fluid communication. Heating chamber 230 has a volume that is substantially smaller than the volume of hot water chamber 2 to decrease the time required for generating the first vapor or steam. By providing a substantially smaller volume in heating chamber 230, heater 99 is only required to heat a significantly smaller amount of the water to its boiling point. Heating chamber 230 further includes a number of ribs 233 that partially separate the heating chamber into a number of smaller portions, which can be more rapidly heated.

Figure 7:
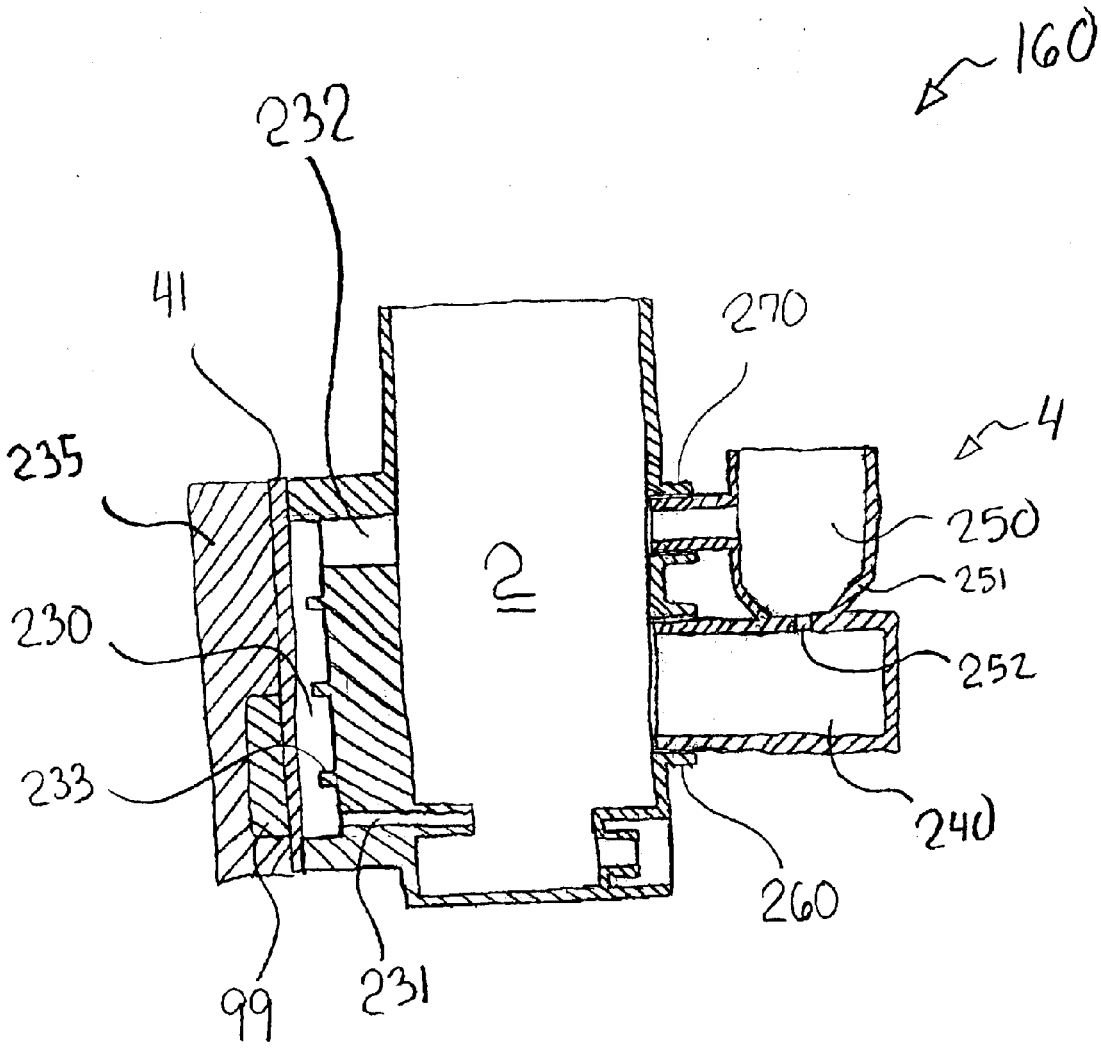
FIG. 7 is a cross-sectional view of the steam device of the sauna of FIG. 1.

Referring to FIG. 7, heater 99 heats metal plate 41, which transfers the heat to the water in heating chamber 230. Preferably, metal plate 41 is made of a material having high thermal conductivity to further facilitate rapid heating of the water. As the water is heated above its boiling point, steam flows through the higher second opening 232 and back into hot water chamber 2 near the top of the hot water chamber. To maximize the efficiency of heater 99 and further facilitate rapid heating of the water, the heater is substantially surrounded by a heat sink 235 as shown in FIG. 7, which facilitates distribution of the heat along metal plate 41 and throughout heating chamber 230. Alternatively, other arrangements of the heater 99 with the heating chamber 230 and hot water chamber 2 can be used to facilitate rapid heating of the water by heating only small portions of the water at a time.

Referring to FIGS. 6 and 7, hot water chamber 2 also has a sub-boiler 4 having a substantially tubular shape, with first and second ends 240, 250. Sub-boiler 4 is adjacent to hot water chamber 2 on the opposite side from heating chamber 230. First end 240 of sub-boiler 4 is in fluid communication with hot water chamber 2 through a first passage 260 and a second passage 270. First passage 260 is located near the base of sub-boiler 4 and allows flow of water between hot water chamber 2 and the sub-boiler. Second passage 270 is located near the middle of sub-boiler 4 and is substantially aligned with the second opening of heating chamber 230. First and second ends 240, 250 of sub-boiler 4 are separated by a tapered flange 251 that extends inwardly from the inner sidewalls of the sub-boiler to form a sub-boiler hole 252 therethrough. The flange is located between first and second passages 260, 270 of sub-boiler 4. The sub-boiler 4 has a hole that has a diameter substantially smaller than the diameter of the sub-boiler.

Second end 250 of sub-boiler 4 is connected to a flexible steam spout 29. Steam spout 29 is curved toward the front of housing 8 and is aligned with and positioned under intake 120 of steam nozzle 15 such that sub-boiler 4, hot water chamber 2 and heating chamber 230 are in fluid communication with the steam nozzle. The steam flows from heating chamber 230, through hot water chamber 2, through sub-boiler 4, through steam spout 29, and out through steam nozzle 15 into hood 22.

Referring to FIG. 6, mist device 150 and steam device 160 are powered and controlled by an electronic circuit 170.

Electronic circuit 170 contains electrical components, which provide for rapid heating of the water by steam device 160 and simultaneous supplying of mist from mist device 150 and steam from steam device 160. Electronic circuit 170 can also allow for adjustments by the user, such as, for example, temperature, flow and time. In this embodiment, sauna 1 is controllable through controllers 171, 172. However, alternative user interfaces can also be employed, such as, for example, pushbutton controls. Also, the present disclosure contemplates the use of indicator devices, such as, for example, signal lights or displays, which provide information regarding the status of the sauna 1 to the user.

Referring to FIGS. 1, 2, and 6, hood 22 is substantially frusto-conical in shape having a first open end 280 and a second open end 290 formed by a circumferential sidewall 300. First open end 280 can engage a user's face. Second open end 290 can engage face 100 of top 10 and be secured thereto. As shown in FIG. 6, second open end 290 preferably has a flange 310 extending inwardly from sidewall 300 of hood 22. Flange 310 preferably has two semi-circular indentions 320 formed therein. Face 100 of top 10 preferably has a flat surface 330 surrounding steam nozzle 15 and mist hole 110, with two semi-circular projections 340 extending from the flat surface. Hood 22 is preferably secured to top 10 by engaging semi-circular projections 340 with semi-circular indentions 320, and resting hood flange 310 against flat surface 330 of top 10. However, alternative structures can be used to secure hood 22 to top 10.

As shown in FIG. 6, first open end 280 of hood 22 is larger than second open end 290. Hood 22 has an outer rim 350 with a shape that can fittingly engage a user's face, allowing the cold mist and/or steam to flow directly onto the user's face.

Sauna 1 further has a duct 23 shown in FIGS. 4 and 5. Duct 23 has an upper portion 360 having an open end 370. Upper portion 360 has a substantially frusto-conical shape. Duct 23 also has a lower portion 380 having an open end 390. Open end 390 of lower portion 380 is larger than open end 370 of upper portion 360. Mist and/or steam flow through open end 390 and lower portion 380 into upper portion 360 and out through upper portion open end 370. The open end 390 of lower portion 380 preferably fittingly engages with a rim 400 formed on face 100 of top 10 that surrounds flat surface 330.

Figure 9:
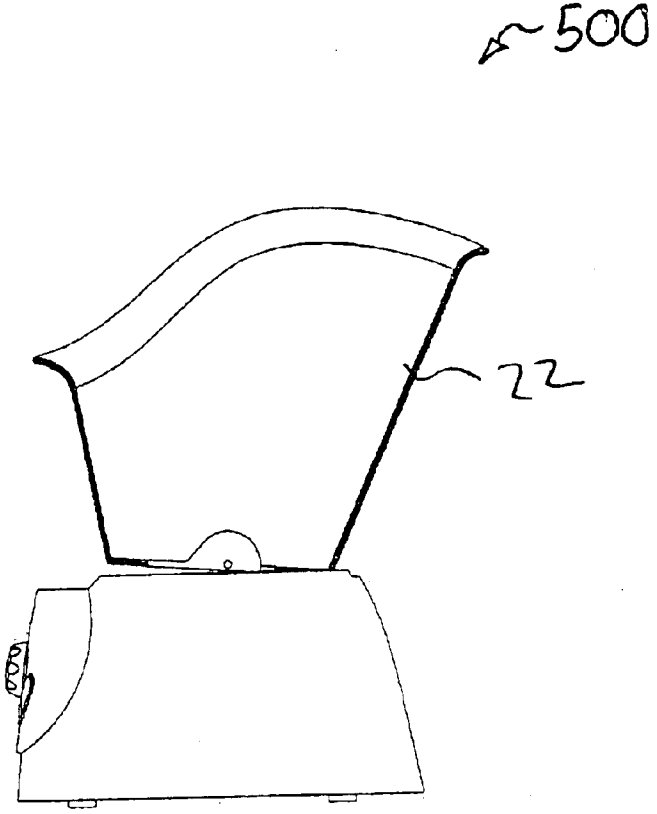
FIG. 9 is a side view of the sauna of FIG. 8.
Figure 8:
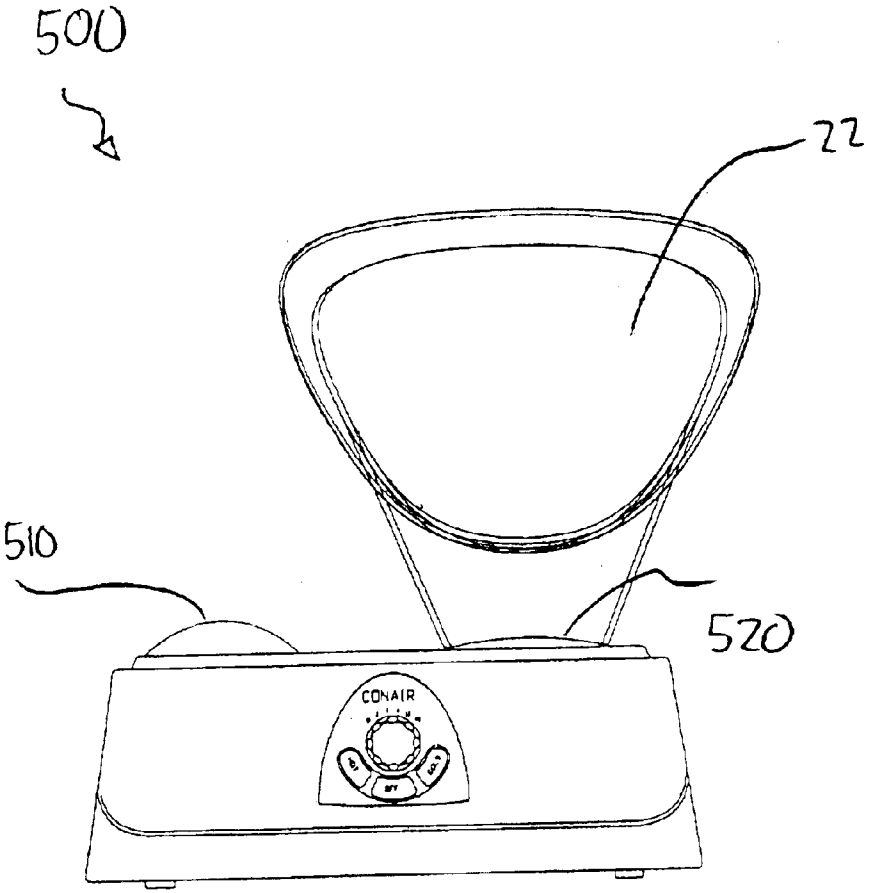
FIG. 8 is a front view of another embodiment of a sauna of the present invention.

Referring to FIGS. 8 and 9, another embodiment of the sauna of the present invention is provided and generally represented by reference numeral 500. Sauna 500 has two wells 510, 520 that exhaust cold mist and hot steam, respectively. Wells 510, 520 are positioned adjacent to each other. Hood 22 is engageable with either well 510, 520 preferably in the same manner as described above. Sauna 500 can generate hot steam, cold mist or both at the same time.

While the instant invention has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

What is claimed is:

1. A sauna device for vaporizing a substance comprising:

a body having an exhaust area and a vapor apparatus, wherein said vapor apparatus generates a first vapor having a first temperature from said substance and generates a second vapor having a second temperature from said substance, wherein said vapor apparatus can provide said first and second vapors to said exhaust area at substantially the same time, wherein said exhaust area has an adjustable valve pivotally and rotatably movable to a plurality of positions to adjust a direction of flow of said first vapor wherein said vapor apparatus can provide said first vapor and said second vapor individually to said exhaust area.

2. The device of claim 1, wherein said first temperature is above a boiling point of said substance, and wherein said second temperature is below said boiling point of said substance.

3. The device of claim 2, wherein said second temperature is at or below room temperature.

4. The device of claim 3, wherein said vapor apparatus is a first apparatus and a second apparatus, and wherein said first apparatus has a heater that heats said substance to generate said first vapor.

5. The device of claim 1, wherein said vapor apparatus is a first apparatus and a second apparatus, and wherein said second apparatus has a transducer that vibrates said substance to generate said second vapor.

6. The device of claim 4, wherein said first apparatus has a first chamber with a first volume and a second chamber with a second volume, wherein said first volume is substantially smaller than said second volume, wherein said heater is in thermal communication with said first volume and in substantial thermal isolation from said second volume, and wherein said first and second volumes and said exhaust area are in fluid communication.

7. The device of claim 1, further comprising a hood that substantially surrounds said exhaust area thereby forming an exhaust volume.

8. The device of claim 7, wherein said exhaust volume is sized for a user's face.

9. The device of claim 1, wherein said exhaust area has a first opening for exhausting said first vapor and a second opening for exhausting said second vapor.

10. A sauna device for use with a substance comprising:

a first vapor apparatus having a heater, a first chamber with a first volume, and a second chamber with a second volume; and an exhaust area in fluid communication with said first vapor apparatus, wherein said first volume is substantially smaller than said second volume, wherein said heater is in thermal communication with said first volume for heating said substance thereby generating a first vapor from said substance, wherein said heater is in substantial thermal isolation from said second volume, and wherein said first and second volumes are in fluid communication a second vapor apparatus in fluid communication with said exhaust area, wherein said second vapor apparatus has an air pump and a transducer for generating a second vapor from said substance, wherein said exhaust area has a first opening for exhausting said first vapor and a second opening for exhausting said second vapor, wherein said first opening has an adjustable valve movable into a plurality of positions to adjust a direction for flow of said first vapor.

11. The device of claim 10, wherein said first vapor apparatus has a thermally conductive plate partially defining said first volume, wherein said first volume has a thin rectangular shape, and wherein said heater is in thermal communication with said thermally conductive plate.

12. The device of claim 11, wherein said first vapor apparatus has a heat sink in thermal communication with said heater and said thermally conductive plate.

13. The device of claim 10, further comprising a water chamber for storing said substance, wherein said first vapor apparatus and said second vapor apparatus are in fluid communication with said water chamber.

14. The device of claim 10, wherein said first and second vapor are provided to said exhaust area at the same time.

15. The device of claim 14, wherein said first and second vapor are individually provided to said exhaust area.

16. The device of claim 10, wherein said second vapor has a second temperature that is at or below room temperature.

17. The device of claim 1, further comprising a hood that substantially surrounds said exhaust area thereby forming an exhaust volume.

18. The device of claim 17, wherein said exhaust volume is sized for a user's face.

19. A method of providing vapor to a user comprising:

generating a first vapor having a first temperature from a substance;

generating a second vapor having a second temperature from said substance;

adjusting an adjustable valve for exhausting said first vapor, wherein said adjustable valve is pivotally and rotatably movable to a plurality of positions to adjust a direction of flow of said first vapor; and providing said first and second vapors to said user at substantially the same time wherein said first and second vapors can be individually provided to said user.

20. The method of claim 19, wherein said first temperature is above a boiling point of said substance, and wherein said second temperature is below said boiling point of said substance.

21. The method of claim 20, wherein said second temperature is at or below room temperature.

22. The method of claim 19, wherein the step of generating said second vapor comprises vibrating said substance and mixing air from an air pump with at least a portion of said substance that has been vibrated.

23. The method of claim 22, further comprising providing a transducer to vibrate said substance.

24. The method of claim 19, wherein the step of generating said first vapor comprises heating only a portion of said substance.

25. The method of claim 24, wherein said portion of said substance is substantially smaller than said substance.

26. The method of claim 25, wherein the step of providing said first and second vapors to said user comprises substantially surrounding said first and second vapors that are exhausted with a hood.

27. The method of claim 26, wherein said hood fittingly engages a user's face.

* * * * *